United States Patent [19]

Pisors et al.

[11] Patent Number: 4,962,847

[45] Date of Patent: Oct. 16, 1990

[54] LIQUID LIFT

[75] Inventors: George L. Pisors, Los Gatos; James T. Taoka, San Jose, both of Calif.

[73] Assignee: Cablelift Oil Corporation, Concord, Calif.

[21] Appl. No.: 344,532

[22] Filed: Apr. 25, 1989

Related U.S. Application Data

[63] Continuation of Ser. No. 112,813, Oct. 23, 1987, abandoned.

[51] Int. Cl.[5] ..... B65G 15/00

[52] U.S. Cl. ..... 198/643; 198/733; 198/731; 474/154; 166/369

[58] Field of Search ..... 198/643, 702, 713, 716, 198/813, 814, 815, 834, 733, 700, 731, 719; 474/203, 204, 95, 154; 166/369, 75.1

[56] References Cited

U.S. PATENT DOCUMENTS

| | | | |
|---|---|---|---|
| 331,562 | 12/1885 | Shortsleeve | 198/716 |
| 587,124 | 7/1897 | James | 198/643 |
| 636,138 | 10/1899 | Hatfield | 474/203 |
| 930,465 | 8/1909 | Fowler | 198/643 X |
| 1,481,735 | 1/1924 | Peck | 198/702 |
| 1,558,490 | 10/1925 | Mayberry | 198/702 |
| 1,703,963 | 3/1929 | Scruby | 198/643 X |
| 1,769,336 | 7/1930 | Detaint et al. | 198/643 X |
| 3,289,593 | 12/1966 | Corry | 198/702 |
| 3,774,685 | 11/1973 | Rhodes | 198/643 X |
| 3,993,184 | 11/1976 | Campbell | 198/716 X |
| 4,089,784 | 5/1978 | Ettelt et al. | 198/700 X |
| 4,197,938 | 4/1980 | Klinkenberg | 198/716 |
| 4,552,220 | 11/1985 | Jones | 198/702 X |

FOREIGN PATENT DOCUMENTS

| | | | |
|---|---|---|---|
| 401629 | 1/1943 | Italy | 198/716 |
| 372882 | 12/1963 | Switzerland | 474/204 |
| 1447169 | 8/1976 | United Kingdom | 198/716 |

*Primary Examiner*—Joseph E. Valenza
*Assistant Examiner*—Cheryl L. Gastineau
*Attorney, Agent, or Firm*—Thomas E. Schatzel

[57] ABSTRACT

A cable pulley transmission has a plurality of pulleys with flight receiving pockets, an endless cable trained about the pulleys, and a plurality of flights located at spaced intervals along the cable. The flights on the cable fit into the flight receiving pockets of the pulleys for transmitting motion between the pulleys and the cable. Each of the flights are formed by two half-sections that are mounted together about the cable. Such a transmission can be used as a lift for liquid. One pulley is located in a source of liquid and at least one pulley is located above the liquid source. The cable has an ascending section and a descending section. The flights are spaced to maintain a column of liquid surrounding the ascending cable section. When the liquid handled is of a lower viscosity than necessary for adhering to the flights and cable of the ascending section, a tube can be positioned about the ascending section to serve as a conduit for conveying liquid therethrough and to hold the pulley in the liquid source. At least one of the flights joins separate cable ends to form an endless cable.

12 Claims, 3 Drawing Sheets

LIQUID LIFT

This is a continuation of co-pending application Ser. No. 07/112,813 filed on Oct. 23, 1987, now abandoned.

BACKGROUND OF THE INVENION

1. Field of the Invention

This invention relates to a power-driven conveyor for lifting liquid from a source, moving the liquid laterally from the source to a position above a nearby holding tank, and stripping liquid from the conveyor to fall by gravity into the holding tank. More specifically, it concerns an endless cable that is trained about a plurality of pulleys with flight receiving pockets therein and a plurality of flights that are located at spaced intervals along the cable for transmitting motion between the cable and the pulleys.

2. Description of the Prior Art

Steel balls with axial bores have been threaded like beads upon a cable and swaged thereon at spaced intervals. The ends of the cable have been joined together to form a loop, and the loop has been used as a drive belt for transmitting motion between a plurality of pulleys having pockets therein for receiving portions of the steel balls. Such balls tend to stiffen the cable because the entire length of the cable passing diametrically through each ball is supported by the ball. Furthermore, threading balls on a cable can be difficult when the cable is of great length and many balls are required.

Endless belt strands or chain-like members have been used to lift viscous liquid from wells, such as heavy crude oil from oil wells. Endless carriers are shown in U.S. Pat. No. 930,465, issued Aug. 10, 1909, to Fowler; U.S. Pat. No. 1,703,963, issued Mar. 5, 1929, to Scruby; U.S. Pat. No. 3,774,685, issued Nov. 27, 1973, to Rhodes; and U.S. Pat. No. 4,089,784, issued May 16, 1978, to Ettelt, et al.

An endless cable with washers thereon is shown in U.S. Pat. No. 1,769,336, issued Jul. 1, 1930, to Detaint, et al. An endless cable with rubber lifters inserted between the cable strands at intervals spaced along the cable is disclosed in Heavy Oiler, Issue 13, Apr. 1985, pages 14–15. Heavy Oiler is a quarterly newsletter published by UNITAR/UNDP INFORMATION CENTER FOR HEAVY CRUDE AND TAR SANDS, 336 East 45th Street, New York, N.Y. 10017. An endless cable with compressible cups thereon is shown in U.S. Pat. No. 3,289,593, issued Dec. 6, 1966, to Corry. An endless coil spring wrapped about spaced heads interconnected by chains is disclosed by U.S. Pat. No. 587,124, issued Jul. 27, 1897, to James. Endless chains with buckets attached are shown in U.S. Pat. No. 1,481,735, issued Jan. 22, 1924, to Peck; U.S. Pat. No. 1,558,490, issued Oct. 27, 1925, to Mayberry; and U.S. Pat. No. 4,552,220, issued Nov. 12, 1985, to Jones. The buckets in U.S. Pat. No. 1,558,490 have a ball-like shape with openings therein and liquid is carried inside the buckets.

When endless belt strands or cable are used for lifting liquid from a source, it is desirable to increase the diameter of width of a column of liquid surrounding the upwardly noving cable and thereby the liquid output of the lift. When a cable is coated with viscous liquid, such as a heavy oil, there is a tendency for it to slip on a drive pulley, and sometimes more positive means than merely being trained thereabout are required for transmitting motion between the pulley and the cable. Preferrably, oil should be stripped from the cable before reaching the drive pulley. The cable should be flexible so that it can be trained about a small diameter pulley, and both ascending and descending cable portions can be located within a narrow passage, such as a well casing.

SUMMARY OF THE PRESENT INVENTION

An object of the present invention is to lift a column of liquid surrounding a cable ascending from a liquid source.

Another object of the invention is to form flights in half-sections that can be mounted together about a cable instead of threading the cable through holes in the flights.

A further object of the invention is to minimize the restriction of each flight on the flexibility of the cable.

In accordance with the present invention, there is provided a lift for liquid. The lift includes a plurality of pulleys with flight receiving pockets therein. One pulley is located within a liquid source and at least one pulley is located above the liquid source. An endless cable is trained about the pulleys, and the cable has ascending and descending sections. Flights are located at spaced intervals along the cable to maintain a column of viscous liquid surrounding the ascending cable section. These flights fit within the flight receiving pockets of the pulleys for transmitting motion between the pulleys and the cable. In a preferred form of the invention, a flight is formed preferrably in the shape of a sphere or spheroid, by a pair of half-sections that are mounted together about the cable. The length of cable supported between flight half-sections is less than the flight diameter to minimize the restriction of the flight on the flexibility of the cable.

Advantages of the present invention include the ability to lift a column of viscous liquid surrounding an ascending cable section, the ability to form flights by mounting half-sections about a cable instead of threading the cable through holes in the flights, and minimizing the restriction of each flight on the flexibility of the cable.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
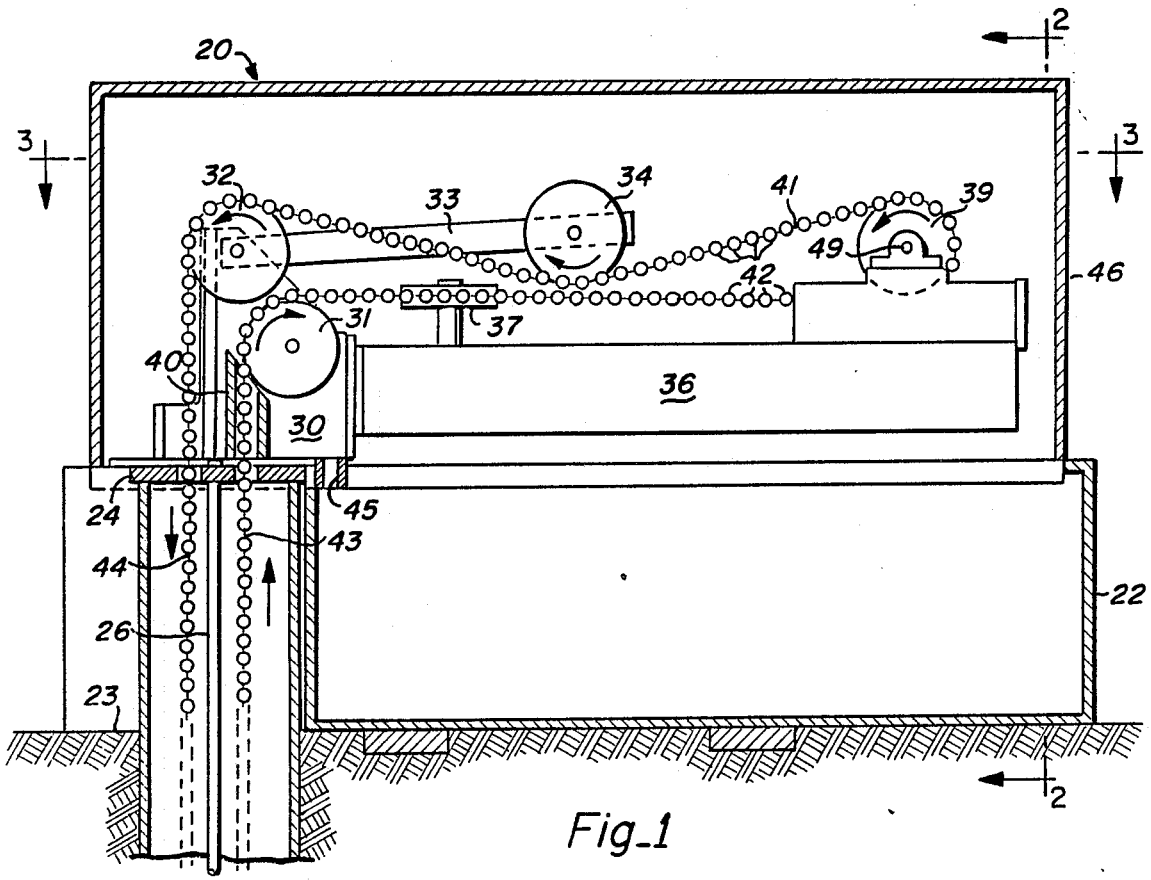
FIG. 1 is a section in elevation of a viscous liquid lift embodying the present invention.

Looking now at FIG. 1, a viscous liquid lift, indicated by the general reference numeral 20, is mounted above the top of a liquid source 21, such as an oil well casing, and extends downwardly therein. A holding tank 22 fits about a portion of the casing extending above an earth surface 23, and an adapter 24 is mounted on top of the casing. An arm 26 depends from the adapter into the casing to support a pulley retainer 27 having a well pulley 28 mounted therein. A cable retainer 29 covers the bottom of the pulley retainer so that if the cable breaks, it can be withdrawn from the well casing by raising the arm. On top of the adapter is a support 30 for idler pulleys 31 and 32. Extending from the support 30 is a pivotal link 33 for holding an idler pulley 34 that adjusts tension in the cable. A cantilever beam 36 extends horizontally from the support. A pair of stripper pulleys 37 and 38 (FIG. 3) and a drive pulley 39 are mounted on the cantilever beam. An endless cable 41 with flights 42 mounted at spaced intervals therealong is trained about the pulleys. The flights are preferrably in the shape of a sphere or spheroid to provide more surface area for liquid to adhere to and less energy is required for liquid to cling to this shape. The cable has an ascending section 43 and a descending section 44 within the well casing. Positioned about the ascending section above the adapter 24 is a tube 40 that extends upwardly to the idler pulley 31. A drain 45 is provided from the support 30 to the tank 22. A cover 46 is mounted on top of the holding tank, and this cover encloses the pulleys.

Figure 2:
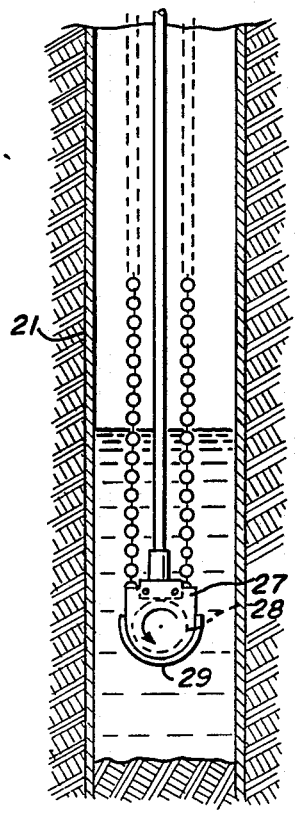
FIG. 2 is a transverse section taken on line 2—2 of FIG. 1.
Figure 2:
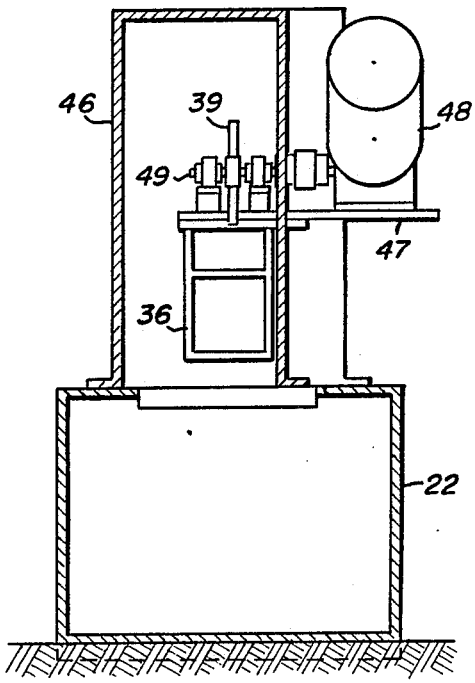
Figure 3:
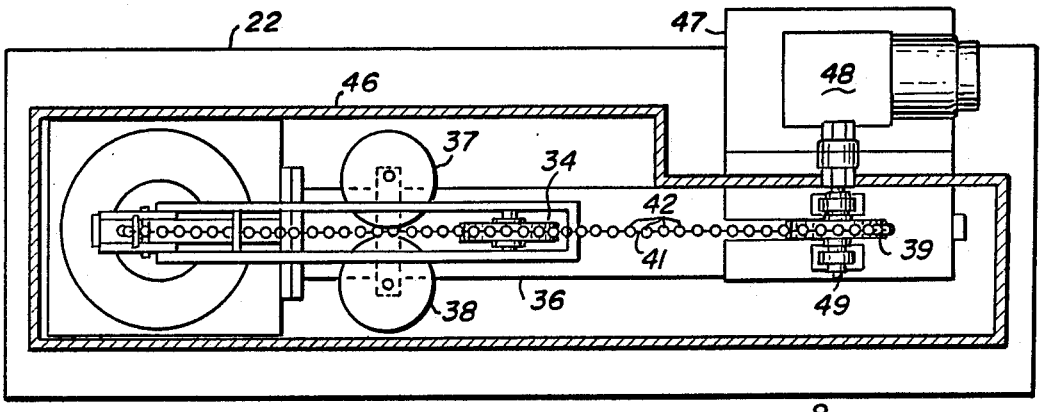
FIG. 3 is a horizontal section taken on line 3—3 of FIG. 1.

With reference to FIGS. 2 and 3, a motor mounting plate 47 extends laterally from the top of cantilever beam 36 through a cut-out in the cover 46. A variable speed motor 48 of the explosion proof type, so that it can be located in a gaseous atmosphere, is mounted on the motor mounting plate outside the cover. The motor drives a shaft 49 on which the drive pulley 39 is mounted. Since the motor speed can be varied, the lift speed can be regulated in accordance with the viscosity of the liquid being raised to achieve an optimum output.

Figure 4:
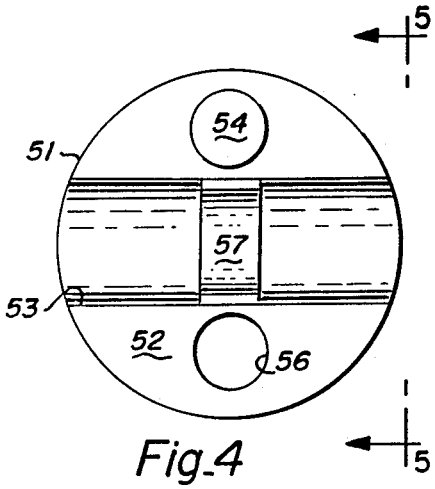
FIG. 4 is an enlarged detail view of a ball half-section.
Figure 5:
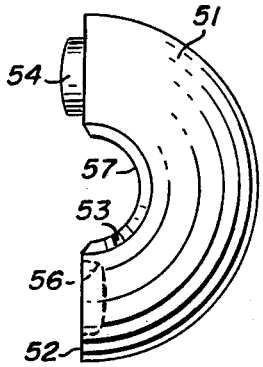
FIG. 5 is a view taken on line 5—5 of FIG. 4.
Figure 6:
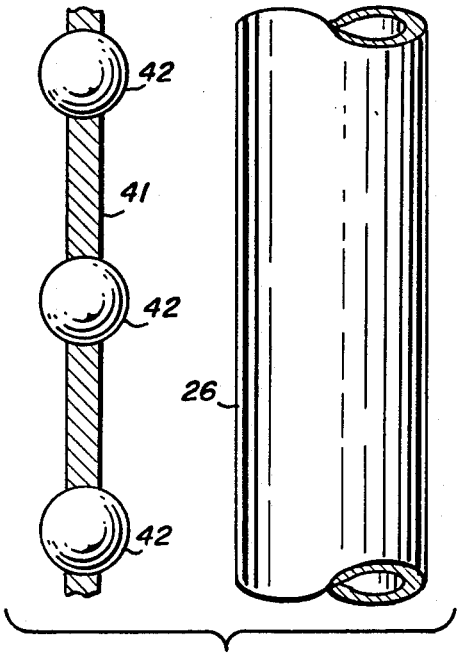
FIG. 6 is an enlarged elevational view of an ascending cable with balls thereon and an adjacent arm.

As shown in FIGS. 4 and 5, a flight half-section 51 has a generally hemispherical shape with a planar side 52. A semi-circular groove 53 extends axially along the planar side. A projection 54 and an indentation 56 are provided on opposite sides of the groove on the planar side. A contact ridge 57 near the midpoint of the semi-circular groove is provided for supporting the flight half-section on the cable 41 as shown in FIG. 6. Since the contact ridge has a width that is less than one-fifth the diameter of the flight half-section, the cable can flex within a ball 42 on opposite sides of the contact ridge. Thus, restriction by the flight on the flexibility of the cable in minimized. A flight can be formed about the cable by positioning two half-sections so that the projections interfit with the indentations, compressing the half-sections together, and welding the half-sections at the indentations and projections by applying opposite electrodes to the flight half-sections.

FIG. 6 shows a portion of cable 41 with flights 42 thereon in relationship to the arm 26. When liquid of high viscosity adheres to the cable and flights, a column of viscous liquid having a width larger than the diameter of the flights surrounds the cable. The flights are spaced at intervals along the cable to prevent the liquid from tapering inward toward the cable before the following flight. It has been found for handling heavy crude oil, a 3/16 inch cable with 9/16 inch diameter flights on centers spaced at 1.2 inches works satisfactory. When liquid of lower viscosity is handled, it tends to flow down the cable and laterally to the arm 26 where it builds up thereon until liquid extends between the cable and the arm.

Figure 7:
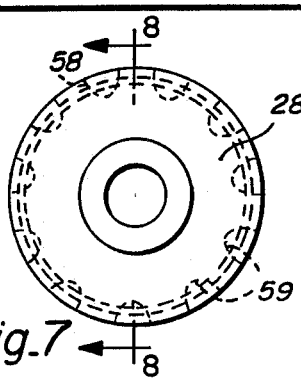
FIG. 7 is a detail view of a well pulley.
Figure 8:
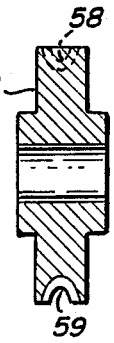
FIG. 8 is a section taken on line 8—8 of FIG. 7.
Figure 9:
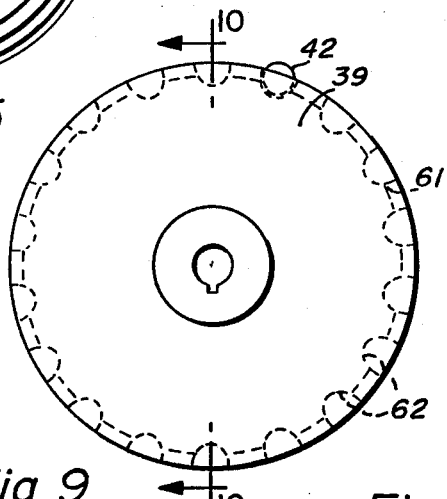
FIG. 9 is a detail view of a drive or idler pulley.
Figure 10:
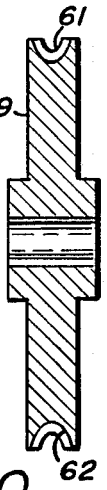
FIG. 10 is a section taken on line 10—10 of FIG. 9.
Figure 11:
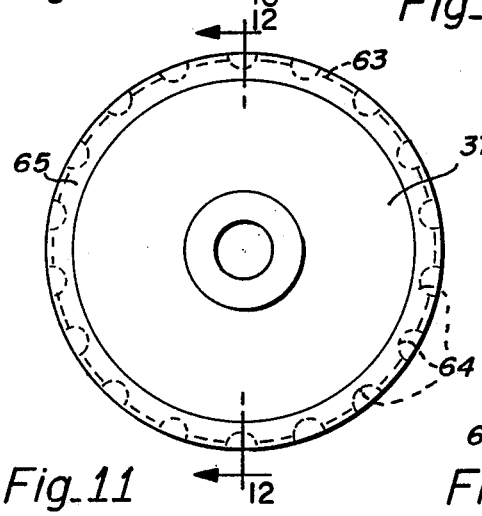
FIG. 11 is a detail view of stripper pulley.
Figure 12:
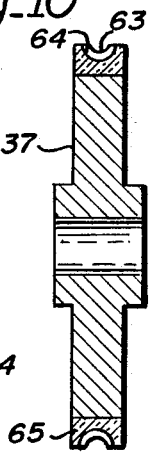
FIG. 12 is a section taken on line 12—12 of FIG. 11.

FIGS. 7 and 8 show the well pulley with a cable receiving peripheral groove 58 and flight receiving pockets 59. The drive pulley 39, shown in FIGS. 9 and 10, has a cable receiving peripheral groove 61 and flight receiving pockets 62. The idler pulleys 31, 32 and 34 are similar to the drive pulley. A spherical flight 42 is shown in one pocket 62 and it should be noted that the flight does not bottom out in the pocket, but contacts the conical sidewall thereof. This assures that load transferred through the flight between the pulley and the cable will be applied for transmitting motion therebetween. The stripper pulley 37, shown in FIGS. 11 and 12, has a cable receiving peripheral groove 63 and flight receiving pockets 64 in a rim 65 that is fixed to a hub of the pulley. The stripper pulley 38 is similar to the stripper pulley 37.

Figure 13:
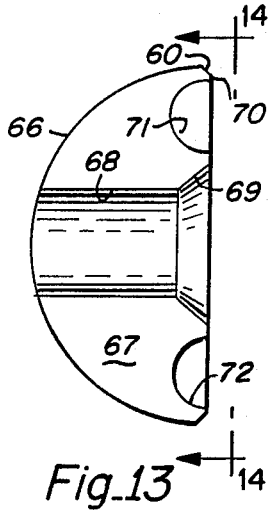
FIG. 13 is an enlarged detail view of a flight quartr-section.
Figure 14:
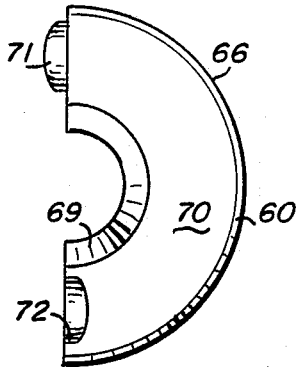
FIG. 14 is a view taken on line 14—14 of FIG. 13.
Figure 15:
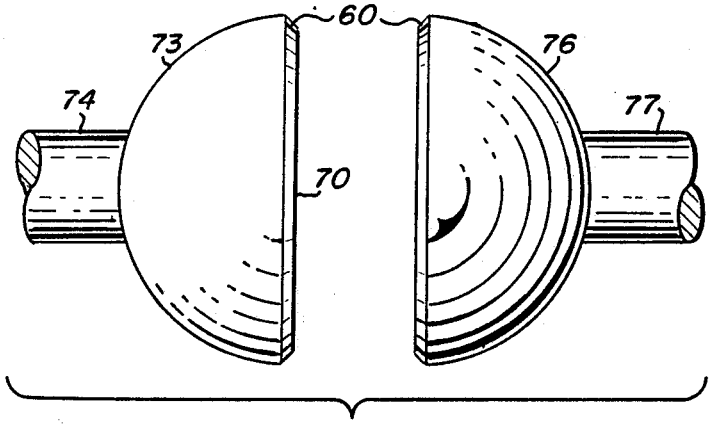
FIG. 15 is a detail view showing two cable ends with half-flights mounted thereon formed by two quarter-flight sections.
Figure 16:
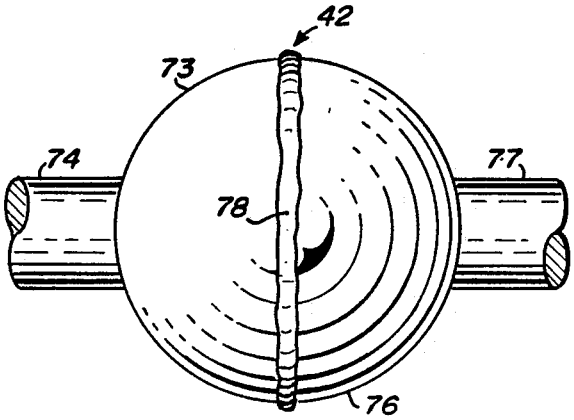
FIG. 16 is a detail view showing the two half-flighs welded together to form a flight that also joins separate ends of the cable.

Looking now at FIGS. 13 and 14, a flight quarter-section 66 has a diametrical planar surface 67 with a semi-circular axial groove 68 therein. A conical tapered section 69 flares outwardly from one end of the groove to a diametrical planar surface 70. The surfaces 67 and 70 are perpendicular to each other. A chamfer 60 is provided between the surface 70 and the semi-sphercial surface of the quarter-section. Extending from the planar surface 67, on opposite sides of the groove 68, is a projection 71 and an indentation. 72. As shown in FIG. 15, a half-flight 73 can be formed about a cable end 74 by positioning two quarter-sections 66 so that the projections interfit with the indentations, compressing the quarter-sections together, and welding the quarter-sections at the indentations and projections by applying opposite electrodes to the quarter-sections. The cable end 74 is splayed within the flared section and silver soldered in place therein Similarly, a half-flight 76 can be formed about a cable end 77. Then the half-flights 73 and 76 can be joined together by an annular weld 78 on the diametrical plane 72 to form a flight 42, as shown in FIG. 16.

Figure 17:
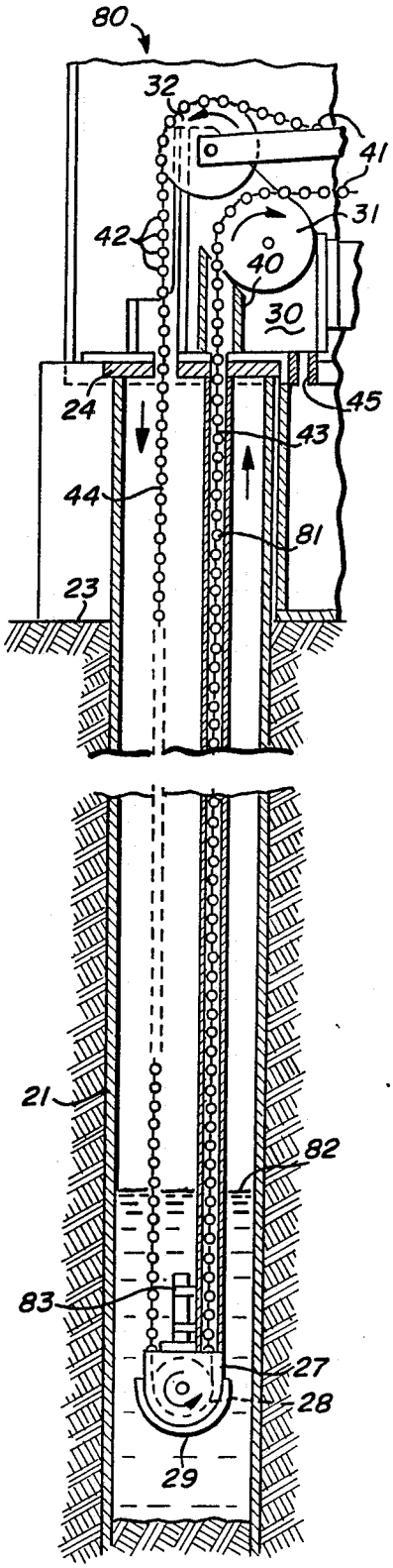
FIG. 17 is a section in elevation of a liquid lift embodying a modified form of the invention.

With reference to FIG. 17, a modified lift for liquid of a lower viscosity than necesary to adhere to the flights and cable of an ascending section is indicated by general reference numberal 80. This lift is similar to that shown in FIG. 1, so like parts will be given the same reference numerals and no further description is considered necessary. The main distinction between lifts 20 and 80 is that a tube 81 is provided about the ascending section 43 of the cable 41. This tube takes the place of the arm 26, shown in FIG. 1, and also serves as a conduit for conveying liquid from a source 82 to the adapter 24. The cable 41 and the flights 42 draw liquid upwardly through the tube which fits closely about the flights. Due to the close fit, there is a general upward flow of liquid in the tube. A pulley retainer 27 is mounted by a bracket 83 to the lower end of the tube.

From the foregoing description, it will be seen that a lift 20 for viscous liquid includes a plurality of pulleys 28, 39, 31, 32 and 34 with flight receiving pockets 59 and 62 therein. One pulley 28 is located within an oil well casing 21 that contains viscous liquid and at least one pulley 39, 31, 31 and 34 is located above the top of the well casing. An endless cable 41 is trained about the pulleys, and the cable has ascending section 43 and descending section 44. Flights 42 are located at spaced intervals along the cable to maintain a column of viscous liquid surrounding the ascending cable section. These flights fit within the flight receiving pockets 59, 62 and 63 of the pulleys for transmitting motion between the pulleys and the cable. A flight is formed by a pair of half-sections 51 that are mounted together about the cable. The length of cable supported between flight half-sections is less than the flight diameter to minimize the restriction o the flight on the flexibility of the cable. Since only the viscous liquid adheres to the cable and flights, the lift effectively separates heavy crude oil from surface water thereon within the oil well casing. A modified lift 80 has a tube 81 surrounding an ascending section 43 of cable 41 so that flights 42 draw lower viscosity liquid upwardly through the tube.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. In a cable-pulley transmission having:

a plurality of pulleys with flight receiving pockets;

an endless cable trained about the pulleys; and a plurality of flights located at spaced intervals along the cable, said flights fitting into the flight receiving pockets of the pulley for transmitting motion between the pulleys and the cable;

the improvement comprising each of said flights being formed by two half-sections that are welded together about the cable in direct gripping relationship therewith, the length of the cable gripped between two half-sections of a flight is substantially less than the flight length along the cable to minimize the restriction of the flight on the flexibility of the cable.

2. The cable-pulley transmission of claim 1 wherein, the length of cable gripped between two half-sections of a flight is less than one-fifth the flight length along the cable.

3. The cable-pulley transmission of claim 1 wherein, said flight half-sections have contact ridges located at central portions of the half-sections for gripping the cable between opposite contact ridges.

4. The cable-pulley transmission of claim 1 wherein, each of said flight half-sections have a planar side with a projection and an indentation relative to the planar side, said projection and indentation of one flight half-section being inter-fitted with a corresponding indentation and projection of the opposite half-section of the flight, said flight half-sections being welded together at the indentations and projections.

5. A lift for liquid comprising:

a plurality of pulleys with flight receiving pockets, one pulley being located for positioning within a source of liquid and at least one pulley being located for positioning above the top of the liquid source;

an endless cable trained about the pulleys, the cable having an ascending section and a descending section; and a plurality of flights located at spaced intervals along the cable for maintaining a column of viscous liquid surrounding said ascending cable section and for transmitting motion between the pulleys and the cable, each of the flights being formed by two half-sections mounted together about the cable in direct gripping relationship therewith, the length of cable gripped between two half-sections of a flight being substantially less than the flight length along the cable to minimize the restriction of the flight on the flexibility of the cable.

6. The lift of claim 5 wherein, the length of cable gripped between two half-sections of a flight is less than one-fifth the flight length along the cable.

7. The liquid lift of claim 5 wherein, said flight half-sections have contact ridges located at central portions of the half-sections for gripping the cable between opposite contact ridges.

8. The liquid lift of claim 5 wherein, said flight half-sections have a generally hemispherical shape with a groove for receiving the cable.

9. In a cable-pulley transmission having:

a plurality of pulleys with flight receiving pockets;

an endless cable trained about the pulleys; and a plurality of flights located at spaced intervals along the cable, said flights fitting into the flight receiving pockets of the pulley for transmitting motion between the pulleys and the cable;

the improvement comprising each of said flights being formed by two half-sections that are welded together about the cable in direct gripping relationship therewith, the length of cable supported between two half-sections of a flight is less than the flight length along the cable to minimize the restriction of the flight on the flexibility of the cable.

10. A lift for liquid comprising:

a plurality of pulleys with flight receiving pockets, one pulley being located within a source of liquid and at least one pulley being located above the top of the liquid source;

an endless cable trained about the pulleys, said cable having an ascending section and a descending section;

a plurality of flights located at spaced intervals along the cable for maintaining a column of liquid surrounding the ascending cable section and for transmitting motion between the pulleys and the cables; and an arm depending from the top of the liquid source for holding down the pulley located within the source of liquid, said arm being a tube surrounding the ascending section of the cable.

11. A method of forming a flight about a cable comprising the steps of:

positioning two flight half-sections having projections and indentations about the cable so that the projections are aligned to interfit with the indentations, compressing the flight half-sections into gripping engagement with the cable and interfitting relationship between the projections and indentations, and welding the flight half-sections at the interfitted projections and indentations by applying opposite electrodes to the flight half-sections.

12. A lift for liquid comprising:

a plurality of pulleys with flight receiving pockets, one pulley being located for positioning within a source of liquid and at least one pulley being located for positioning above the top of the liquid source;

an endless cable trained about the pulleys, the cable having an ascending section and a descending section; and a plurality of flights located at spaced intervals along the cable for maintaining a column of viscous liquid surrounding said ascending cable section and for transmitting motion between the pulleys and the cable, each of said flights are formed by two half-sections mounted together about the cable in direct gripping relationship therewith, the length of cable supported between two half-sections of a flight is less than the flight length along the cable to minimize the restriction of the flight on the flexibility of the cable.

* * * * *